United States Patent [19]

Brouse et al.

[11] 4,164,176

[45] Aug. 14, 1979

[54] STRAPPING MACHINE WITH STRAP STOP BARRIER, PIVOTABLE CLAMP AND ADJUSTABLE SHEAR ANVIL

[75] Inventors S. Bernard, Brouse, Orland Park; John Wiedel, Chicago, both of Ill.

[73] Assignee: United States Steel Corporation, Pittsburgh, Pa.

[21] Appl. No.: 879,645

[22] Filed: Feb. 21, 1978

[51] Int. Cl.[2] ..... B65B 13/04

[52] U.S. Cl. ..... 100/4; 100/26

[58] Field of Search ..... 100/4, 26, 30, 32

[56] References Cited

U.S. PATENT DOCUMENTS

| | | | |
|---|---|---|---|
| 3,183,824 | 5/1965 | Cook | 100/4 |
| 3,232,217 | 2/1966 | Harmon | 100/26 X |
| 3,269,300 | 8/1966 | Billett | 100/4 X |
| 3,442,734 | 5/1969 | Ericsson | 100/32 X |
| 3,447,447 | 6/1969 | Rutty | 100/4 |
| 3,526,187 | 9/1970 | Gilliard | 100/4 X |
| 3,687,059 | 8/1972 | Plattner | 100/4 |
| 3,906,851 | 9/1975 | Clark | 100/4 |
| 3,929,063 | 12/1975 | Stromberg | 100/26 |

FOREIGN PATENT DOCUMENTS

| | | | |
|---|---|---|---|
| 1176711 | 1/1970 | United Kingdom | 100/26 |
| 1176712 | 1/1970 | United Kingdom | 100/26 |

*Primary Examiner*—Billy J. Wilhite

*Attorney, Agent, or Firm*—William F. Riesmeyer, III

[57] ABSTRACT

An improved strapping machine has a barrier for stopping travel of the strap at a precise location, a sensor which is activated by contact of the strap with the barrier so as to terminate operation of the strap feed means and a guide means for preventing buckling of the strap within the sealing assembly portion of the machine. In another aspect of the invention the clamping device has a first gripper located in fixed position during feeding and clamping, and a second gripper which is pivotable from a guide position to a clamping position. In a preferred form, one end of the second gripper bar serves as a shear anvil which co-acts with the blade to sever the strap. The shear anvil is adjustable so that the gap between the blade and anvil may be regulated to compensate for wear.

5 Claims, 7 Drawing Figures

STRAPPING MACHINE WITH STRAP STOP BARRIER, PIVOTABLE CLAMP AND ADJUSTABLE SHEAR ANVIL

BACKGROUND OF THE INVENTION

1. Field of the Invention

Strapping machines for binding articles are well known and generally perform the following operation in sequence, feeding strap into a loop about an article, clamping the free end of strap, withdrawing strap to tension the loop about the article, sealing overlapped portions of the strap together and shearing the loop from the remaining strap. A machine for performing the above sequence of operations is shown in U.S. Pat. No. 3,232,217.

2. Description of the Prior Art

One of the difficulties encountered with strapping machines is the failure to stop the strap in precisely the same location upon repetitive feeding cycles so that the exact same length of overlap is obtained on each cycle. If insufficient overlap is obtained, the strap may not be properly sealed and will come undone. Excessive overlap on the other hand may catch in the machine preventing ejection of the bound article, or at least cause a waste of strap material and a potential safety hazard from an exposed strap end. The machine shown in U.S. Pat. No. 3,906,851 provides a sensor located upstream from the sealing assembly where the strap overlap is formed and a positive stop in the area of the sealing assembly. This combination depends upon a controlled delayed termination of the strap feed to assure that the strap engages the stop. Slight variations in strap feed speed or in the extent of the delay cause varying degrees of strap overlap.

Another difficulty with prior machines has been that the complicated clamping mechanisms for holding the free end of the strap while the loop is tensioned require frequent repairs. Generally a pair of clamping arms are mounted on pivotable linkages and driven by a separate hydraulic cylinder as shown in U.S. Pat. Nos. 3,232,217 and 3,687,059. Such arrangements require undue maintenance and adjustment due to the large number of parts involved.

Finally, the shearing mechanisms of strapping machines used for feeding steel strap wear with extended use and must be adjusted or replaced. Although this does not usually require a complete disassembly of the machine it is often difficult to perform due to location of the shear and its means of adjusting and holding in place. Since shear wear occurs in proportion to amount of use the result is frequent and extended downtime.

SUMMARY OF THE INVENTION

According to this invention, the improved strapping machine comprises a barrier for stopping travel of the strap within the sealing means at a precise positioning upon re-entry therein so as to control the extent of overlapped strap, a sensor activated by said barrier for terminating operation of the feed means, and means for preventing buckling of the strap within the sealing means.

Another aspect of the improved machine of this invention is a clamping means with a first gripper bar located in fixed position during clamping adjacent to a re-entry guide track section along the inner periphery of the loop, a second gripper bar comprising a pivotable re-entry guide track section, means for pivoting said re-entry guide track to the clamping position, and means for returning the same to the guide position. The re-entry guide track section may have a planar end aligned parallel to the plane of movement of the shear blade and displaced therefrom slightly to provide a gap therebetween for severing the strap from the loop when the blade is extended. A means for adjusting the shear gap may be provided by movement of the second gripper bar back and forth in a direction perpendicular to the plane of movement of the shear blade.

It is an object of this invention to provide a strapping machine which uniformly controls the extent of overlapped strap portions on repetitive feeding cycles.

It is another object of this invention to provide a strapping machine with a clamping means having fewer moving parts and which requires less maintenance than those previously known.

It is a further object of this invention to provide a strapping machine having a more effective means for adjusting the shear without dismantling or disassembly of said machine.

These and other objects of this invention will become more apparent from a reading of the following detailed description when taken in conjunction with the appended claims and drawings, in which:

DESCRIPTION OF THE PREFERRED EMBODIMENT

Machines for applying a strap about an article and for sealing overlapped portions of the strap are known and, in general, perform the basic sequence of operations including: (1) feeding a strap into a loop about an article, (2) clamping the free end of the strap, while (3) withdrawing the remaining strap to tension the loop, (4) sealing the overlapped strap portions, and (5) shearing the loop from the remaining strap. For a showing of such a machine, reference is made to U.S. Pat. No. 3,232,217, the description of which is incorporated herein.

Figure 1:
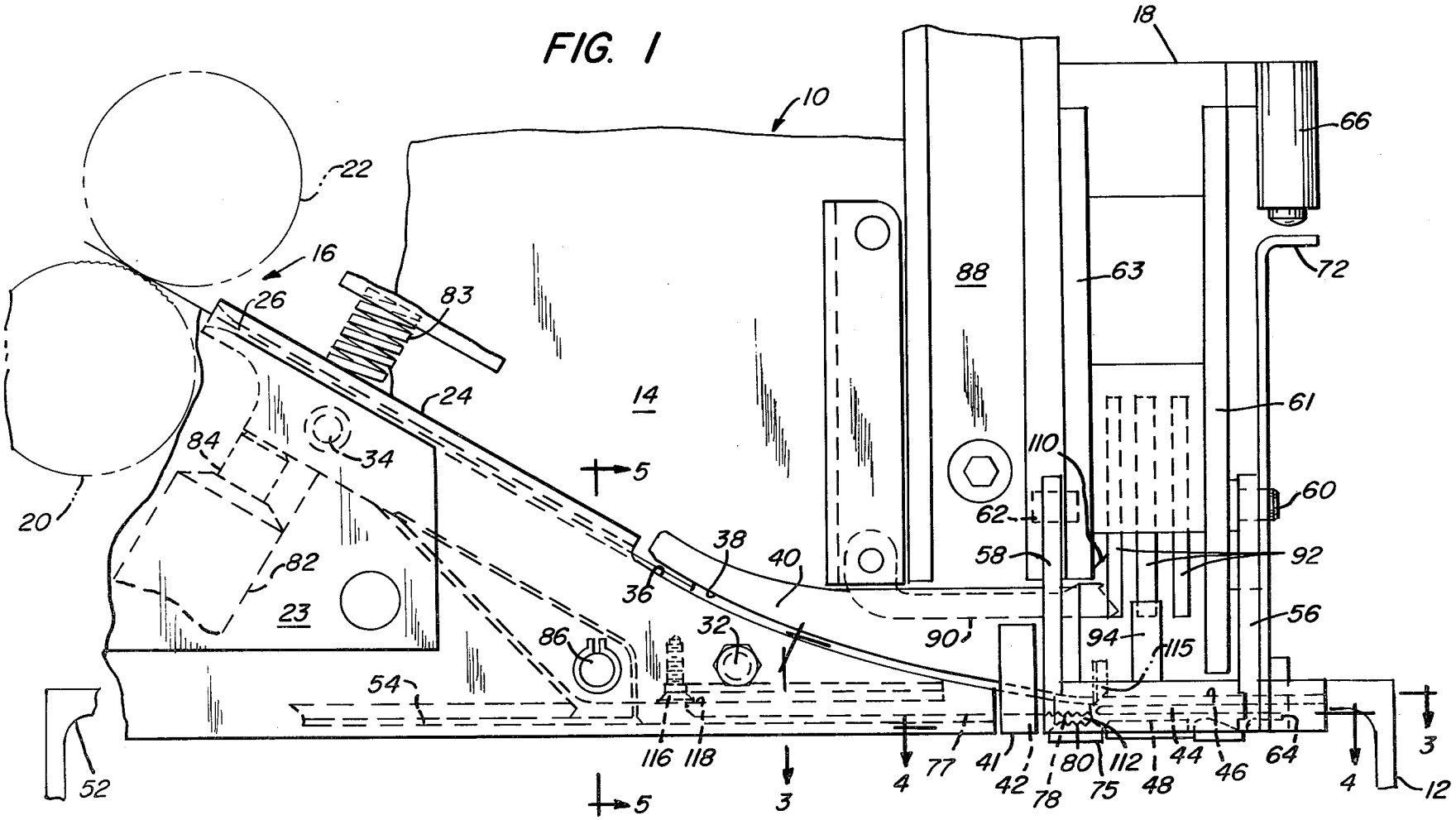
FIG. 1 is a side elevation of the strapping head of this invention, showing portions of the feed assembly and sealing assembly.

Although not limited thereto, applicants' invention will be described in reference to a machine for applying flat metal strap about an article, and sealing the same with a metal clip crimped about overlapped strap portions. The machine comprises a strapping head 10 (FIG. 1) which is associated with a loop track 12 (shown partially) in a strapping line wherein an article is transported by a system of conveyor rolls (not shown) into position within loop track 12 so as to receive a strap loop therearound.

Figure 5:
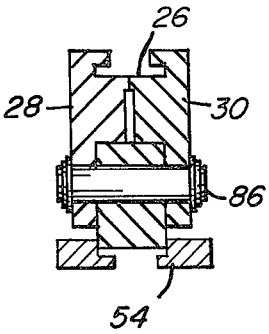
FIG. 5 is a sectional view along 5—5 of FIG. 1.
Figure 6:
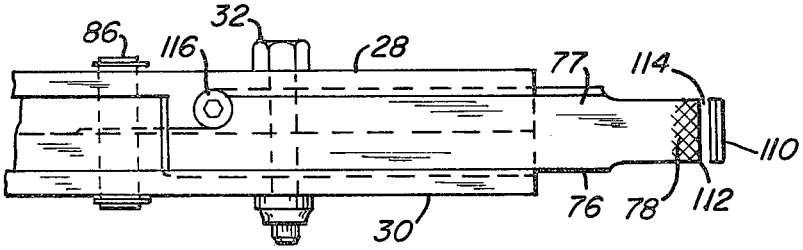
FIG. 6 is a partial bottom view of FIG. 1, with strap guidance track removed and end view of shear blade shown.
Figure 7:
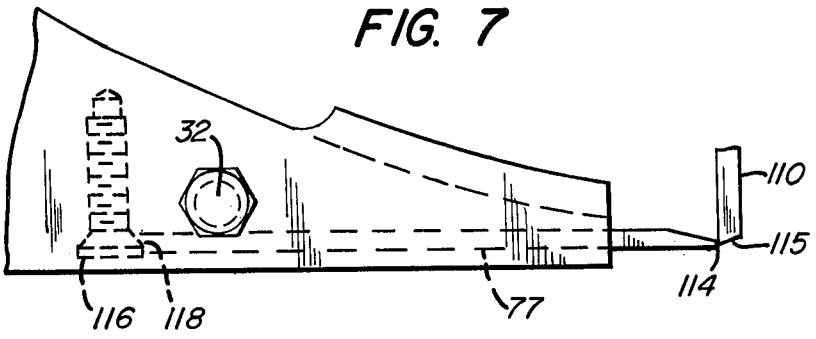
FIG. 7 is a partial side elevation of the apparatus of FIG. 1 showing the shear blade extended to cutting position.

Head 10 has a side plate 14 (FIG. 1) serving as a frame on which feeding assembly 16 (FIG. 1) and sealing assembly 18 (FIGS. 1, 2) mounted. Feeding assembly 16 includes a feed means comprising driven knurled surface tension wheel 20 (FIG. 1) and smooth peripheral surface back-up wheel 22 (FIG. 1) and a reversible motor (not shown) located within housing 23 for driving wheels 20 and 22 forwardly for feeding strap or in reverse direction for withdrawing strap to tension the loop. Wheels 20, 22 pull the strap when feeding from a coil dispenser (not shown) and pass it into entry guide 24 (FIG. 1) of the feeding assembly 16, which has slot 26 (FIGS. 1, 5) formed in half sections 28, 30 (FIGS. 5, 6) bolted together at 32 (FIGS. 1, 6) and 34 (FIG. 1) and downstream from slot 26 a guide surface 36 (FIG. 1) opposite guide surface 38 (FIG. 1) of seal-strap guide 40 (FIG. 1) of sealing assembly 18.

Figure 4:
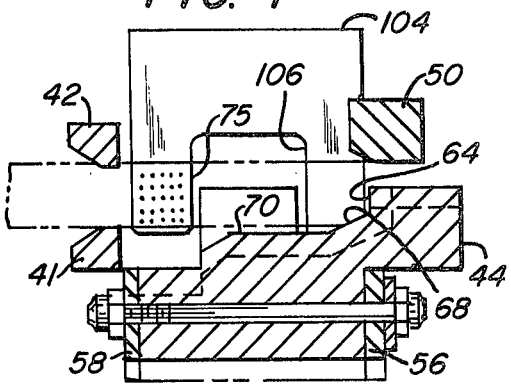
FIG. 4 is a sectional view along 4—4 of FIG. 1.

The strap is aligned by a guide means preferably shown as spaced pillars 41, 42 (FIGS. 1, 3, 4) adjacent the exit end of entry guide 24 for guiding the strap into sealing assembly 18. Located within sealing assembly 18 is a means for preventing buckling of the strap, preferably a guideplate 44 (FIGS. 1, 2, 3, and 4) with separate elongated paralled tracks 46 (FIGS. 1, 2, 3) 48 (FIGS. 1, 2, 4) in overlying relationship running longitudinally therethrough, each of said tracks enclosing somewhat more than one-half of the cross section of the strap along its longitudinal direction, the other somewhat less than one half of the cross section being unconfined except by pillar 50 (FIGS. 3, 4) which also serves as a guide means for guiding the strap in the sealing assembly 18. On the initial pass through sealing assembly 18, the strap travels along track 46 as received from entry guide 24. The strap passes through sealing assembly 18 by way of track 46 into loop track 12 which forms a loop about the article to be bound. The strap exits from loop track 12 at 52 (FIG. 1) and passes into re-entry guide 54 (FIGS. 1, 5) of the feeding assembly 16 secured to frame 14. The strap passes through re-entry guide 54, through pillar 41, 42 back into sealing assembly 18 which as shown is along track 48 of guideplate 44, so that portions of the strap are overlapping.

Guideplate 44 is attached to sideplates 56, 58 (FIGS. 1, 2, 3, 4) and together therewith is pivotably mounted about pins 60, 62, (FIGS. 1, 2) of sideplates 61, 63 (FIG. 1) of the sealing assembly 18 which in turn are secured to frame 14. Track 48 of guideplate 44 has a barrier encroaching thereon comprising a planar wall 64 (FIGS. 1, 4) perpendicular to the path of travel of the strap for physically blocking and stopping travel thereof. Wall 64 precisely controls the extent of strap overlap on repetitive feeding cycles, and prevents ineffective sealing due to insufficient strap overlap, and also strap waste due to excess overlap. Means is provided for activating a sensor 66 (FIGS. 1, 2) when the strap contacts wall 64 indicating travel of the strap is terminated. Sensor 66 initiates an electrical signal when activated which is carried by way of conventional circuitry to the motor driven wheel 20 and back-up wheel 21 so as to terminate rotation thereof. Buckling of the strap in the interval from when strap contacts wall 64 until termination of operation of the feed means is prevented by the separate tracks 46, 48 of guideplate 44. Sensor 66 is preferably a proximity switch such as Catalog No. FYCC 8D3-2B manufactured by Micro Switch Company, a Division of Minneapolis-Honywell Company. The means for activating sensor 66 includes angular wall 68 (FIG. 4) intersecting planar wall 64 of the barrier at about the midpoint thereof and extending upstream therefrom to a point intersecting the wall 70 (FIG. 4) of track 48 in guideplate 44. The strap pivots guideplate 44 as it contacts angular wall 68, and extension 72 (FIGS. 1, 2) of guideplate 44 pivots along with guideplate 44 to position 74 (FIG. 2) and activates sensor 66. Extension 72 is composed of ferrous material so as to activate the proximity switch as it passes before the sensing surface of said switch.

After feeding, the free strap end is held by improved clamping means which according to this invention includes a first gripper bar 75 (FIGS. 1, 3, 4) attached to foot 104 (FIGS. 2, 3, 4) of sealing assembly 18 mounted along the inner periphery of the strap loop adjacent the exit end of re-entry guide 54; a second gripper comprising a guidance track section 77 (FIGS. 1, 3, 6 and 7) of re-entry guide 54 extending along part of the outer side of the periphery of the strap loop with a gripping surface 78 (FIGS. 1, 3, 6) opposite gripping surface 80 (FIG. 1) of first gripper 75, and a means for pivoting guidance track section 77 so as to clamp the strap. The means for pivoting guidance track section 77 includes a hydraulic cylinder 82 (FIG. 1) with piston rod 84 (FIG. 1) engageable against entry guide 24. Track section 77 is mounted within half sections 28, 30 of entry guide 24 which are pivotable about pin 86 (FIGS. 1, 5, 6) in housing 23. The clamping means also includes means for returning track section 77 and entry guide 24 to their guide positions which as shown may be a back-up spring 83 (FIG. 1) acting against entry guide 24 when piston rod 84 is retracted. Rod 84 in retracted position forms a stop means for aligning entry guide 24 and re-entry guide 54 in guiding position, and when extended pivots entry guide 24 and track section 77 mounted therein to clamping position to hold the free end of the strap.

Figure 2:
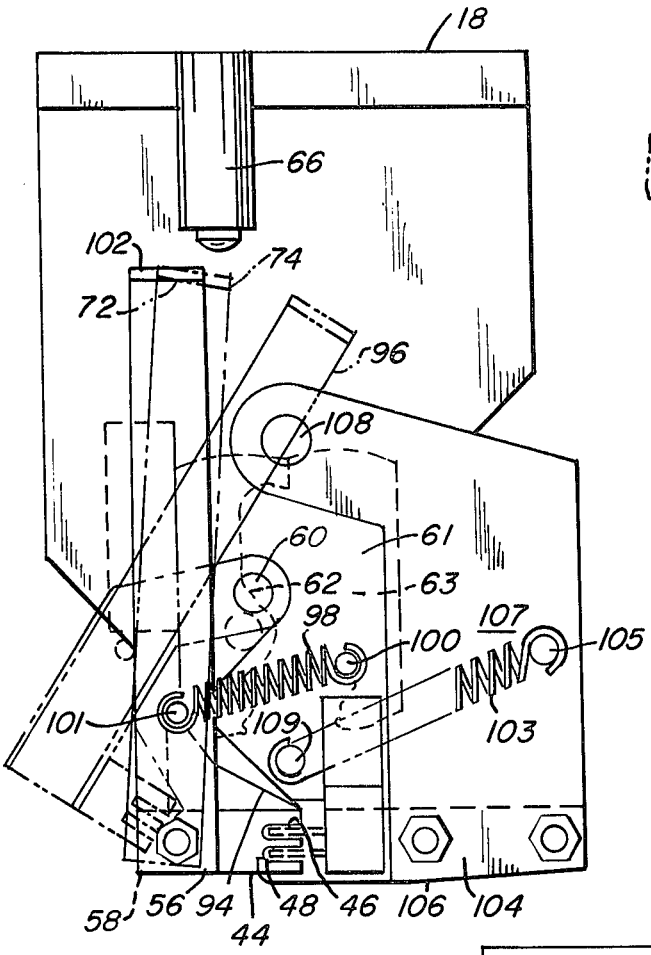
FIG. 2 is an end view of the sealing assembly of FIG. 1.
Figure 3:
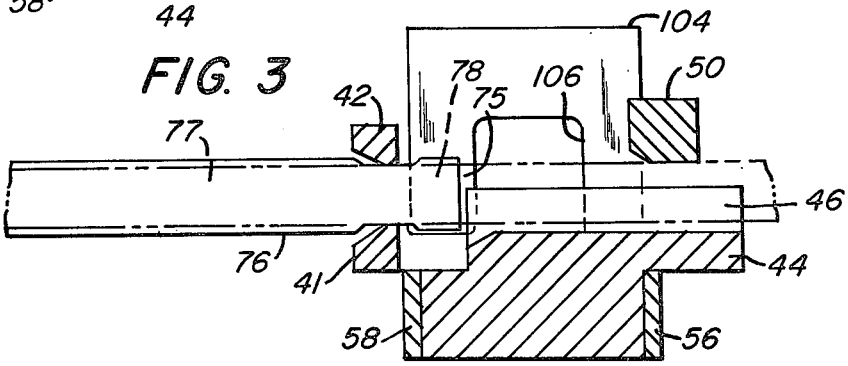
FIG. 3 is a sectional view along 3—3 of FIG. 1.

In operating sequence, after the strap is clamped, the motor driven tension wheel 20 and back-up wheel 22 are reversed so as to withdraw strap, tensioning the loop as strap is released from the loop track in well known fashion tightening about the enclosed article. After tensioning, the overlapped strap portions are sealed in conventional fashion by a clip extracted from magazine 88 (FIG. 1) by ejector 90 (FIG. 1) when it retracts. The clip is then placed in jaws 92 (FIG. 1) of the sealing assembly 18 by extension of ejector 90. Jaws 92 may be of the type shown in U.S. Pat. No. 3,687,059 which move downward by force of a hydraulic cylinder (not shown) to form the clip around the overlapped strap portions and then crimp the clip so as to secure the strap portions together. As jaws 92 move in their downward path they contact cam 94 (FIGS. 1 and 2) of guideplate 44 which serves as means for pivoting guideplate 44 about pins 60, 62 to position 96 (FIG. 2) so as to make room for jaws 92 to crimp the clip over the strap. After retraction of jaws 92 to their uppermost position after sealing, spring 98 (FIG. 2) attached to sideplates 61 of the sealing assembly 18 at pin 100 (FIG. 2) and to sideplate 56 of the guideplate at pin 101 (FIG. 2) returns the guideplate to its guiding position 102 (FIG. 2). Similarly, upward movement of jaws 92 when retracting from extended position cause rotation of foot 104 (FIGS. 2, 3, 4) with guide 106 (FIGS. 2, 3, 4) and first gripper bar 75 attached thereto, about two pins one of which is shown at 108 (FIG. 2) attached to sideplates 61, 63 respectively of the sealing assembly 18 by contact of said jaws with a cam within said sealing assembly (not shown) so as to allow the sealed strap to be released from foot 104 and thus freed from sealing assembly 18 onto the article. A spring 103 (FIG. 2) attached to pin 105 (FIG. 2) in sideplate 107 (FIG. 2) which is also attached to foot 104 and to pin 109 (FIG. 2) in sideplate 61 of the sealing assembly returns foot 104 to guiding position after sealing.

After sealing, the supply portion of the strap is severed to cut the loop from the remaining portion of the strap. Of particular advantage is the fact that guide track section 77 in the machine of this invention serves as a guide, a second gripper bar in the clamping means, and as a shear anvil. This one part is more easily adjustable and replaceable than the several parts in conventional machines which perform these functions. The improved means for shearing the strap in the machine of this invention includes a conventional shear blade 110 (FIGS. 1 and 6) retractable and extendable in conventional fashion by the movement of linkage of jaws 92 in the final stages of their downward movement in crimping the seal and retraction therefrom, and an adjustable shear anvil 112 (FIGS. 1 and 6) which is a planar end of re-entry guide track section 77. A slight gap 114 (FIGS. 1, 6 and 7) is provided between the planar end of said anvil and the plane of movement of shear blade 110 in its extended position 115 (FIG. 6) to provide the desired cutting action. Means for adjusting the gap is provided by screw 116 (FIGS. 1, 6) mounted in a threaded hole in entry guide 24 with a tapered head engageable against tapered end 118 (FIG. 1) of re-entry guide track section 77. Re-entry guide section 77 is mounted in machined longitudinal ways which facilitate movement back and forth providing adjustment of the gap between the anvil and blade. Thus as the anvil wears due to making numerous cuts, the gap may be adjusted to provide a more effective cut before replacement is required.

We claim:

1. In a strapping machine including feed means for longitudinally feeding a free end of strap to form a loop about an article so that a portion of said strap is overlapping, clamping means for holding the strap near the free end, tensioning means for tightening the loop, sealing means for securing the overlapped strap portions, and shearing means for cutting the formed loop from the remaining strap, said machine having an entry guide, a loop track, and a re-entry guide, the improvement in said machine which further comprises:

a barrier for stopping travel of the strap within the sealing means as received from the re-entry guide so as to control the extent of overlapping strap portions therein, a sensor activated by said barrier for terminating operation of the feed means, and, a guideplate having separate parallel tracks in overlying relationship running longitudinally therethrough for conducting the strap through the sealing means as received from the entry and re-entry guides respectively, said tracks enclosing about one half of the cross section of said strap along the longitudinal direction of said guideplate and being open on the opposite half cross section, a guide means spaced from the open side of said tracks so as to guide the strap therealong, said guideplate being pivotally mounted to the sealing means for rotation about an axis parallel to the longitudinal axis of the strap therein; and means for pivoting the guideplate so as to release the strap from the tracks in preparation for sealing.

2. The apparatus of claim 1 wherein said barrier comprises a planar wall in the track aligned with the re-entry guide extending perpendicular to the path of the strap, and an angular wall intersecting the enclosed edge of the track at a point upstream from said planar wall extending to and intersecting said planar wall in a plane at about the midpoint thereof so that the strap pivots the guideplate as it contacts said angular wall activating the sensor when the strap lodges against the planar wall.

3. The apparatus of claim 2 wherein said sensor comprises a proximity switch activated by pivoting of the guideplate so as to pass before said sensor.

4. In a strapping machine including feed means for longitudinally feeding a free end of strap to form a loop about an article so that a portion of said strap is overlapping, clamping means for holding the strap near the free end, tensioning means for tightening the loop, sealing means for securing the overlapped strap portions, and shearing means including a retractable and extendable shear blade and an anvil for cutting the formed loop from the remaining strap, said machine having a frame, an entry guide and a re-entry guide attached thereto, and a loop track associated therewith, the improvement in said machine in which the clamping means comprises:

a first gripper bar mounted within the sealing means along the inner side of the periphery of the loop adjacent said re-entry guide, a second gripper bar comprising an elongated re-entry guide track section attached to the entry guide and having one end thereof extending within the sealing means along the outer side of the periphery of the loop opposite said first gripper bar, said second gripper bar being pivotably mounted about an axis of rotation perpendicular to the longitudinal direction of the strap, a means for pivoting said re-entry guide track section from a guide position during strap feeding to a clamping position holding the strap between said gripper bars, a means for returning said track section to the guide position after clamping, said second gripper bar having a planar end surface which in clamping position is aligned parallel to the plane of movement of the shear blade but displaced therefrom by a slight gap so as to co-act therewith when said blade is extended to sever the remaining strap from the loop, and a means for providing sliding movement of said pivotable gripper bar back and forth in a direction perpendicular to the plane of movement of said shear blade so that the gap between the blade and anvil may be adjusted to compensate for wear.

5. The apparatus of claim 4 wherein the means for providing sliding movement of said second gripper bar comprises a screw means mounted in said entry guide perpendicular to the longitudinal axis of sais pivotable gripper bar with a tapered head engageable against a tapered surface on the end of said pivotable gripper bar which is opposite from the anvil.

* * * * *